US005853338A

United States Patent [19]

Ubriaco

[11] Patent Number: 5,853,338

[45] **Date of Patent: *Dec. 29, 1998**

[54] HOCKEY STICK HAVING AN OFFSET SHAFT AND BLADE TRANSITIONAL CONNECTION

[75] Inventor: Gene Paul Ubriaco, Millersville, Md.

[73] Assignee: International Marketing Management, LLC, Oak Park, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 861,987

[22] Filed: May 22, 1997

[51] Int. Cl.[6] ..... A63B 59/14

[52] U.S. Cl. ..... 473/562

[58] Field of Search ..... 473/560, 562, 473/563, 189

[56] References Cited

U.S. PATENT DOCUMENTS

| | | | |
|---|---|---|---|
| D. 213,838 | 4/1969 | McAllister | D34/5 |
| D. 258,377 | 2/1981 | Nordness et al. | D21/217 |
| 2,146,048 | 2/1939 | Barnhart | 273/80 |
| 3,062,549 | 11/1962 | Duden | 273/81.3 |
| 3,489,412 | 1/1970 | Frank et al. | 273/67 |
| 3,563,546 | 2/1971 | Dawe | 273/67 |
| 4,172,594 | 10/1979 | Diederich | 273/67 |
| 4,358,113 | 11/1982 | McKinnon et al. | 273/67 |
| 4,452,451 | 6/1984 | Dubreuil | 273/67 |
| 4,537,398 | 8/1985 | Salminen | 273/67 |
| 4,544,157 | 10/1985 | Curtis | 273/67 A |
| 4,563,006 | 1/1986 | Hollner | 273/67 |
| 4,664,379 | 5/1987 | Melby | 273/67 |
| 4,793,613 | 12/1988 | Hughes | 273/67 |
| 4,799,682 | 1/1989 | Hughes | 273/67 |
| 5,050,878 | 9/1991 | Deleris | 273/67 |
| 5,263,711 | 11/1993 | Addis et al. | 273/67 |
| 5,292,128 | 3/1994 | Solheim | 273/164 |
| 5,429,352 | 7/1995 | Leclerc | 273/67 |
| 5,456,463 | 10/1995 | Dolan et al. | 273/67 |
| 5,542,666 | 8/1996 | Chou | 473/314 |
| 5,582,405 | 12/1996 | Montgomery | 273/67 A |

FOREIGN PATENT DOCUMENTS

| | | | |
|---|---|---|---|
| 2734328 | 8/1927 | Canada . | |
| 273438 | 8/1927 | Canada | 473/189 |
| 2205757 | 12/1988 | United Kingdom . | |
| 88009687 | 12/1988 | WIPO | 473/189 |

*Primary Examiner*—Mark S. Graham
*Attorney, Agent, or Firm*—Leydig, Voit & Mayer, Ltd.

[57] ABSTRACT

A hockey stick is provided with an offset or bend angular to the plane of the face of the blade and positioned to begin substantially at the location where the transition from the heel of the stick to the shaft becomes approximately equal to the cross section of the shaft in its parallel plane. In a preferred form a second bend then makes a rapid transition to the full offset configuration within the dimension of the shaft such that the blade portion trails the plane of the center line axis of the shaft and due to centrifugal force the trailing blade tends to rotate closed thereby cupping the puck by the blade results in reduced deflection and easier pass reception. According to the preferred embodiments, the offset is positioned where it can be located closest to the blade and in the parallel offset form the completion of the offset to its full off-set dimension takes place dimensionally as is possible within a unitary stick construction of a blade with shaft receiving handle portion. The offset of the invention can be directed positively or negatively angled for different affects and performances.

9 Claims, 9 Drawing Sheets

HOCKEY STICK HAVING AN OFFSET SHAFT AND BLADE TRANSITIONAL CONNECTION

FIELD OF THE INVENTION

The present invention relates generally to hockey sticks having an elongated handle attached to a blade and more particularly to an improved hockey stick which enables a player to more reliably and effectively catch a passed puck, gain control of the puck in a rapid manner, stick handle or pass or shoot a puck quickly, easier and effectively.

BACKGROUND OF THE INVENTION

The game of hockey through its inception has been played with a stick that has a blade portion and an upwardly extending elongated handle portion. Throughout the years numerous patents have been issued by inventors seeking to improve the construction and functionality of the stick by use of new types of materials, composites, forming techniques and variations in the shape of the blade and the handle portion. The sticks have been made in one piece from the same material and in two and three piece constructions of different combinations of materials. Typical examples of the variations and construction of hockey sticks may be found by reference to the following U.S. Patents, merely by way of example:

U.S. Pat. No. 3,489,412, Franck et al., Jan. 13, 1979
U.S. Pat. No. 3,563,546, Dawe, Feb. 16, 1971
U.S. Pat. No. 4,172,594, Diederich, Oct. 30, 1979
U.S. Pat. No. 4,358,113, McKinnon et al., Nov. 9, 1982
U.S. Pat. No. 4,452,451, Dubreuil, Jun. 5, 1984
U.S. Pat. No. 4,537,398, Salminen, Aug. 27, 1985
U.S. Pat. No. 4,544,157, Durtis, Oct. 1, 1985
U.S. Pat. No. 4,563,006, Hollner, Jan. 7, 1986
U.S. Pat. No. 4,664,379, Melby, May 12, 1987
U.S. Pat. No. 4,793,613, Hughes, Dec. 27, 1988
U.S. Pat. No. 4,799,682, Hughes, Jan. 24, 1989
U.S. Pat. No. 5,050,878, Deleris, Sep. 24, 1991
U.S. Pat. No. 5,263,711, Addis et al., Nov. 23, 1993
U.S. Pat. No. 5,306,003, Pagotto, Apr. 26, 1994
U.S. Pat. No. 5,429,352, Leclerc, Jul. 4, 1995
U.S. Pat. No. 5,456,463, Dolan et al., Oct. 10, 1995

Conventionally utilized sticks employ a concavely curved forehand side from the heel to toe of the blade and a convexly curved backhand side from the heel to the toe. After the blade heel portion there is typically a narrowing transition portion which either extends on to become a rectangular elongated handle portion, or terminates slightly beyond where it becomes essentially the rectangular cross section of the handle and there it may be connected either directly to a separate handle in a two-piece construction or by way of a separate sleeve or insert or coupling that connects to an elongated handle in a three-piece construction arrangement.

In the United States professional hockey leagues regulated by the National Hockey League (NHL) are subject to certain general specifications that would preclude players from utilizing completely unorthodox or widely-radical stick configurations and constructions. For example, the 1997 Official Rules of the NHL include Rule 19 on sticks which has the following requirements for a player: "(a) The sticks shall be made of wood or other material approved by the Rules committee, and must not have any projections.

Adhesive tape of any colour may be wrapped around the stick at any place for the purposes of reinforcement or to improve control of the puck . . . (b) No stick shall exceed sixty-three inches (63") in length from the heel to the end of the shaft nor more than twelve and one-half inches (12 ½") from the heel to the end of the blade.

The blade of the stick shall not be more than three inches (3") in width at any point nor less two inches (2"). All edges of the blade shall be beveled. The curvature of the blade of the stick shall be restricted in such a way that the distance of a perpendicular line measured from a straight line drawn from any point at the heel to the end of the blade to the point of maximum curvature shall not exceed one-half inch (½")." The NHL Rules include separate and distinct requirements, of course, with respect to a goalkeeper's stick.

BRIEF SUMMARY OF THE INVENTION

Accordingly, it is a primary object of the invention to provide a hockey stick construction which provides improved stick handling not available in previous stick constructions, but which still does comply with rules and regulations of professional play.

It is also an object of the invention to provide a readily-manufacturable improvement in a hockey stick that lends itself not only to the new stick market, but also would be feasible for use in converting existing sticks as well as lending itself to use in variance of the ice hockey game, such as street hockey.

It is yet another object of the invention and a specific aspect to provide a hockey stick which enhances the ability of a player to receive a passed puck thereby gaining control more quickly for play action.

In accordance with these and other objects of the invention, there is provided an offset or bend angular to the plane of the face of the blade and positioned to begin substantially at the location where the transition from the heel of the stick to the shaft becomes approximately equal to the cross section of the shaft. Preferably in one preferred construction a second bend then makes a rapid transition to the full offset configuration within the dimension of the shaft and its plane parallel to the blade such that the blade portion trails the center line of the shaft and due to centrifugal force the trailing blade tends to rotate closed thereby cupping the puck by the blade results in reduced deflection and easier pass reception. Provision of the offset or bend either positively or negatively angled can be selectively made to have custom performances and affects.

According to the preferred embodiment of the invention, the offset is positioned where it can be located closest to the blade, and with the second bend when utilized the completion of the offset to its full off-set dimension takes place dimensionally as is possible within a unitary stick construction or a blade with shaft receiving handle portion.

The offset configuration of the present invention can be utilized in left-handed or right-handed stick versions and can be readily manufactured with existing and available bending equipment such as is used for forming the blade curvatures at the present time. Moreover, the offset configuration and its benefits may be obtained in two-piece and three-piece configurations as well as being usable for conversion of existing shafts and blades so as to be useable with game variances such as street hockey.

BRIEF DESCRIPTION OF THE DRAWINGS

The invention will be described in reference to certain preferred embodiments as shown in the attached drawings wherein.

DESCRIPTION OF THE PREFERRED EMBODIMENTS

While the invention will be described in reference to the preferred embodiments, it will be obvious to those of ordinary skill in the art that variations of these preferred embodiments may be used and it is intended that the invention may be practiced otherwise than as specifically described herein.

Figure 1:
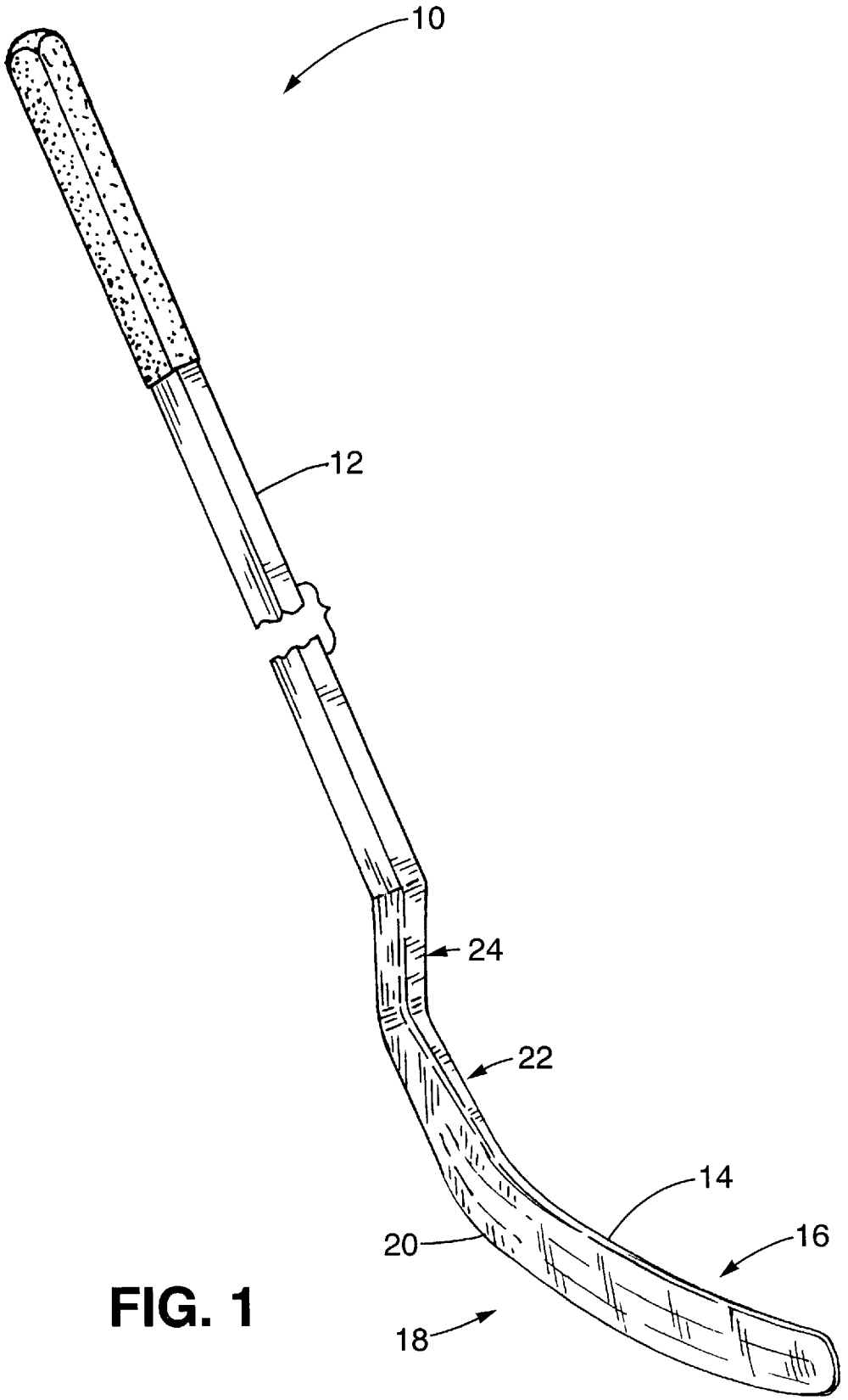
FIG. 1 is a perspective view of an exemplary hockey stick which has a parallel positive offset at the transition between the blade and shaft in accordance with the present invention.

Referring now to FIG. 1, there is shown an exemplary ice hockey stick, indicated generally at 10, having an elongated longitudinal handle 12 attached at its lower end to a curved blade 14. The curvature of blade 14 can be left or right and the amount of curvature or hook can vary. The blade 14 can be straight or neutral by being located in the longitudinal plane of handle 12, bearing in mind that the regulation limits of the curvature of the blades are disclosed, for example, in U.S. Pat. No. 3,902,250, issued to T. B. Lawson.

The blade 14 may be manufactured using woods, wood compositions, and wood and plastic compositions as is well known in the hockey stick art. Examples of hockey stick construction are discussed, e.g., in U.S. Pat. Nos. 4,059,269 to A. Tiitola and 4,052,499 to M. Coupil et al. It should also be appreciated that the present invention may be manufactured entirely of plastic or metal, such as might be used for informal street hockey purposes. The blade 12, is here illustrated as a forehand curve 16 and a backhand curve 18. The blade 12 also includes a heel 20 as shown in FIG. 2.

The blade thickness in cross-section is substantially uniform over a substantial portion of its length and it is considerably less than the width or the length of the blade. For conformity with Official Hockey Rules, the blade may conveniently be no more than about 12 ½" as measured from the heel to the toe end of the blade. Also in conformance with Official Rules, the width of the blade may be conveniently made no more than about 3" and no less than 2" at any point along the blade. Furthermore, in conformance with Official Rules, the curvature of the forehand curve and backhand curve may be conveniently restricted to a maximum of ½" as measured by the distance of a perpendicular line measured between a straight line drawn from any point at the heel to the outer end of the blade and the point of maximum curvature. Furthermore, in conformance with the Official Rules, the length of the linear elongated handle is preferably made no longer than about 63" as measured from the bottom of the heel to the opposite end of the handle.

Figure 2:
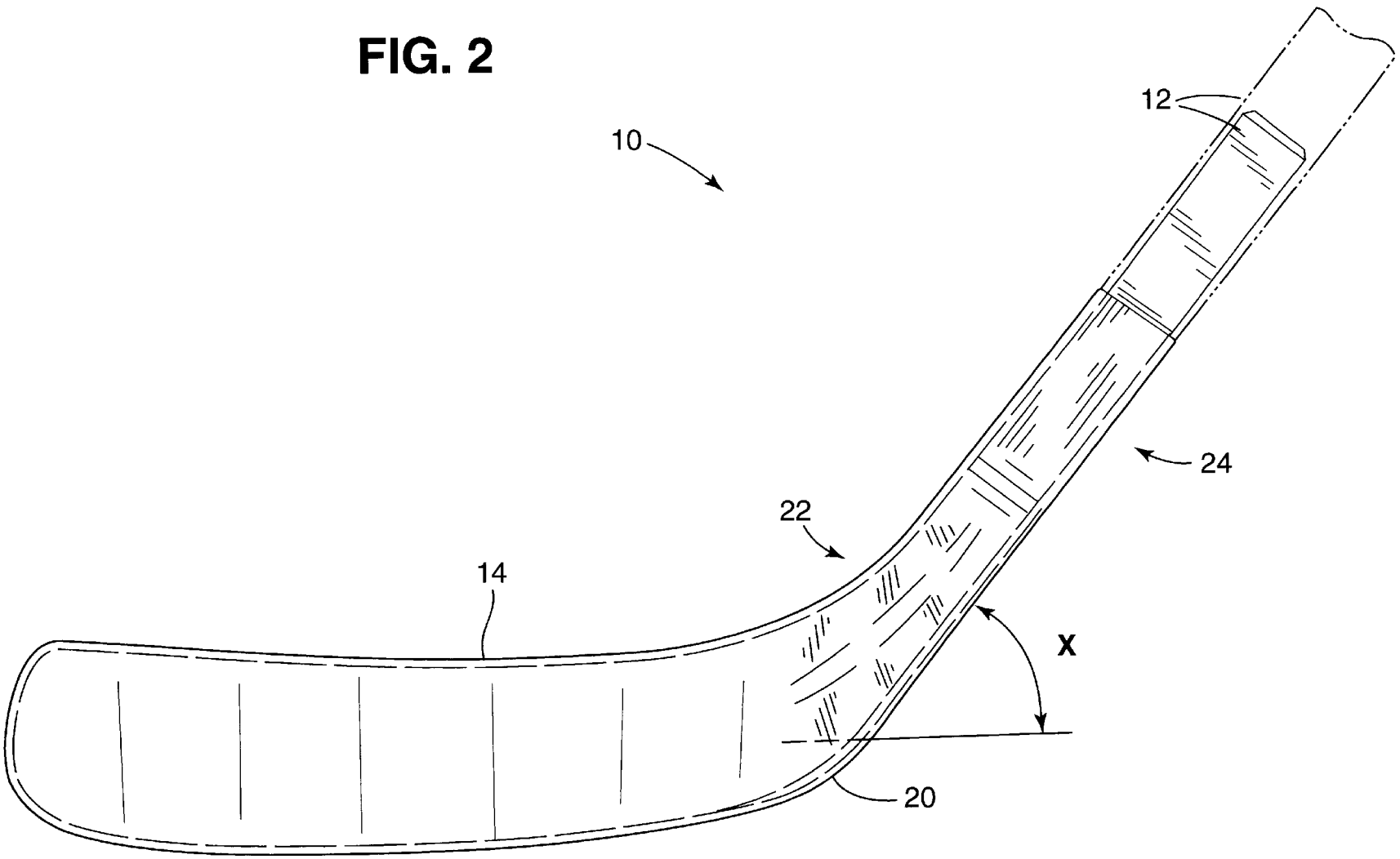
FIG. 2 is a front side elevational view of the hockey stick according to one embodiment of the invention.

As shown in the illustrative embodiment of FIGS. 1 and 2 wherein the stick is essentially a unitary construction between the handle and the blade, starting from the heel 20 and moving toward the beginning of the handle shaft 12, there is a tapering 22 in the parallel plane to the blade and an enlarging in the horizontal cross-section as is well known in the hockey stick art with the shaft being at an obtuse angle x with respect to the blade.

In accordance with the present invention, there is an offset 24 provided which begins approximately where the transition from the heel 20 of the stick to the shaft becomes equal to the cross section of the shaft in its parallel plane. In the present embodiment which is referred to herein as a parallel positive (PP), the offset 24 begins at approximately that location and then a second bend makes as rapid a transition as possible to the full offset which will then place the longitudinal plane of the center axis line of the shaft parallel to the plane of the face of the blade 14. With this PP offset constituting a first bend 28 to the right as looking down the line of sight of the exemplary right handed stick and then a second bend 26 to the left as looking down the line of sight of the shaft. Thus, the shaft is offset forward of the blade, and it is believed that the weight of the shaft tends to rotate the blade closed due to gravity. This results in the cupping of the puck by the blade which further results in reduced deflection, thus making it easier to receive a pass, give a pass, stick handle, and shoot.

Figure 3:
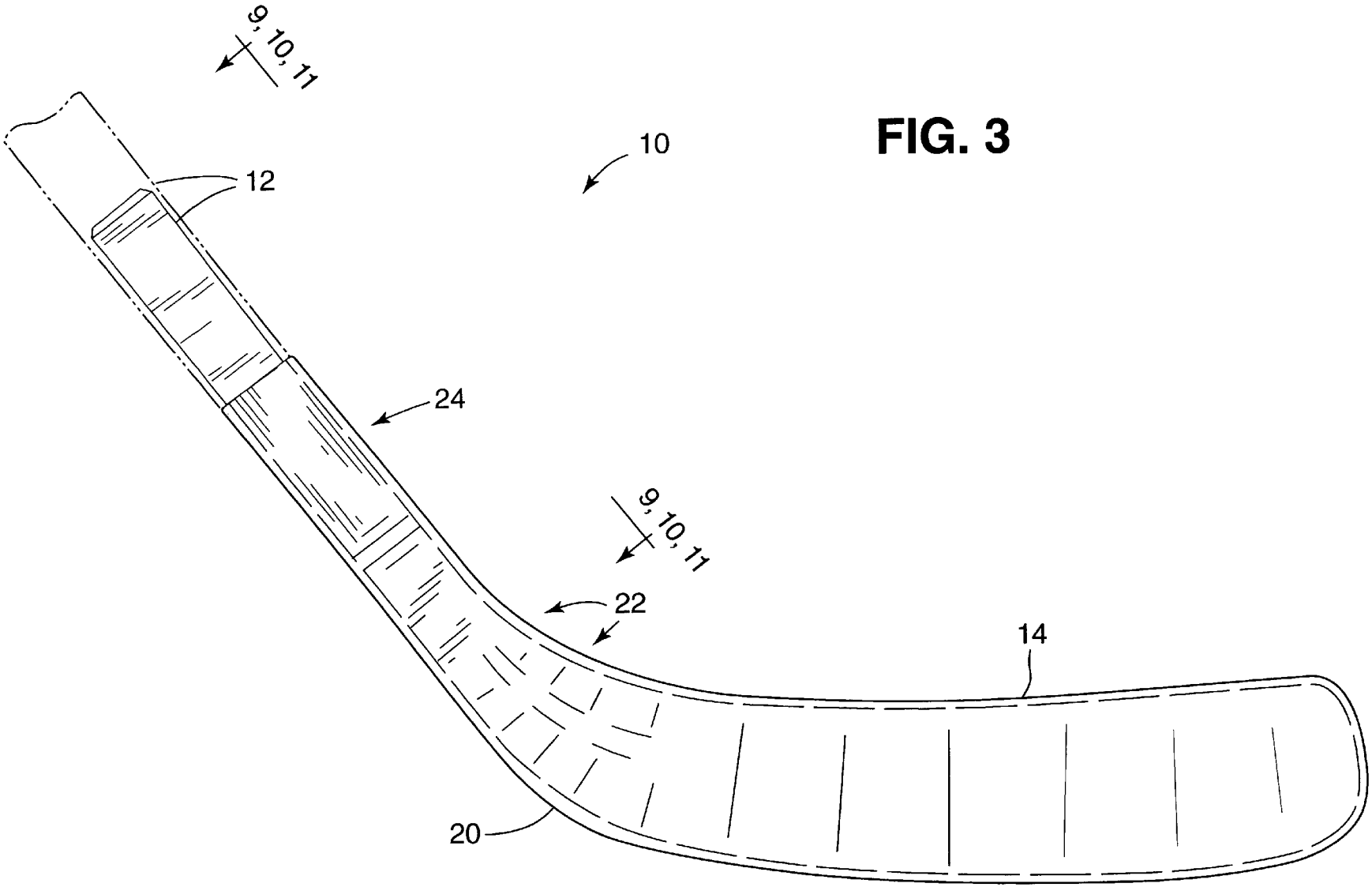
FIG. 3 is a rear side view of the hockey stick in FIG. 2.
Figure 4:
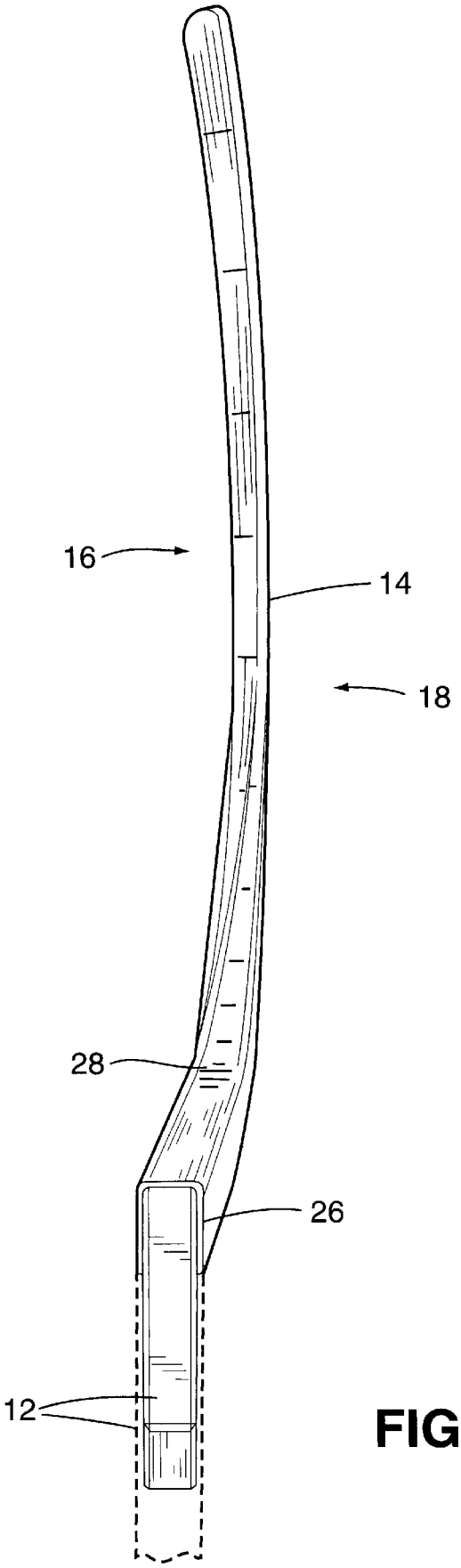
FIG. 4 is a top side view thereof.
Figure 5:
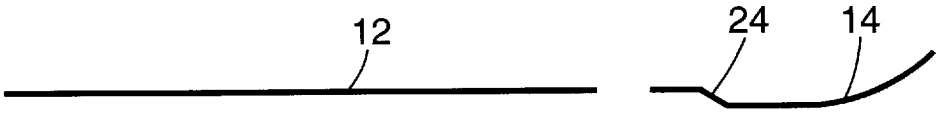
FIGS. 5, 6 and 7 are diagrammatic views of alternative embodiments of the invention.
Figure 6:
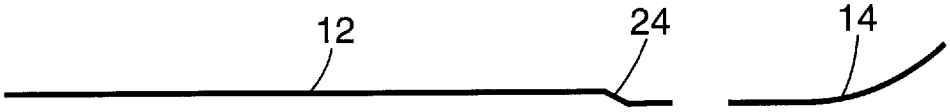
Figure 7:
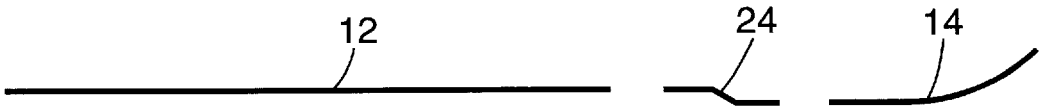

In an alternative embodiment of this invention, the blade 14 and beginning of the shaft insert with the offset can be provided, as shown in FIG. 3, again allowing the offset closest to the blade and the thus provided blade with offset shaft beginning portion can be insertable in all existing shafts without affecting the overall length.

In a further alternative, the offset portion 24 can be moved further up on the shaft 12 so that with a two-piece configuration the shaft may be made of aluminum or a composite with inclusion of the offset portion 24 and then the blade 14 made of wood or composite. With such an arrangement, the offset could be moved upwardly on the shaft approximately 5". Similarly, a three-piece construction could be employed with the offset portion serving to connect the blade and the shaft portion, but again this does move the offset further up the shaft.

It will be appreciated that the offset arrangement between the stick shaft and blade of the invention may be used for ice hockey, street hockey or variations of ice hockey which are played on a surface other than ice and even without skates.

Figure 8:
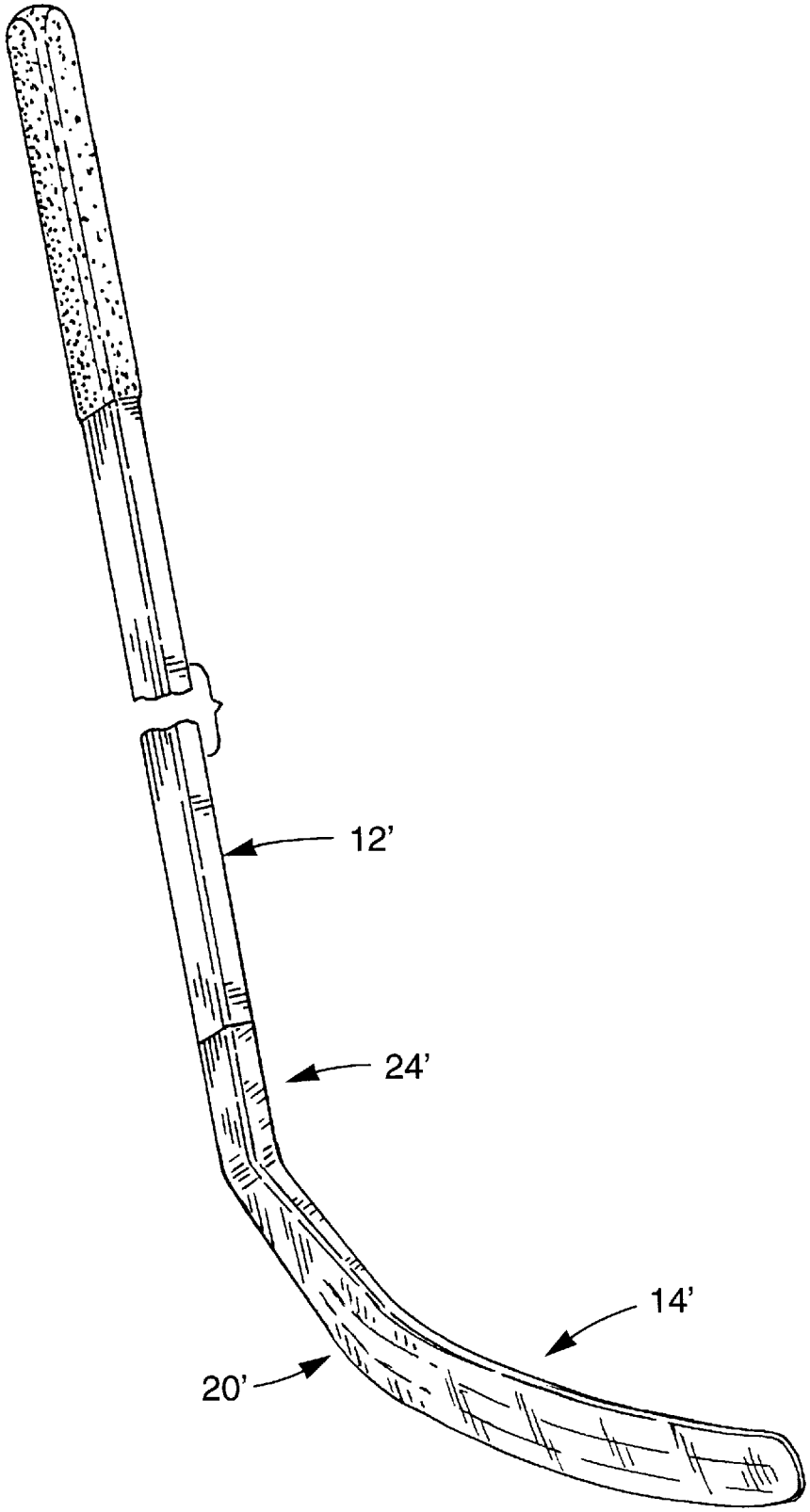
FIG. 8 is a perspective of another alternative with a tangent positive offset in accordance with the invention.

Referring to FIG. 8, there is shown another alternative form of the hockey stick where the offset 24' is a single bend which begins approximately where the transition from the heel 20' of the stick to the shaft becomes equal to the cross section of the shaft in its parallel plane. The handle shaft is in effect tangent to the offset completion and in this embodiment it is tangent positive (TP).

Figure 13:
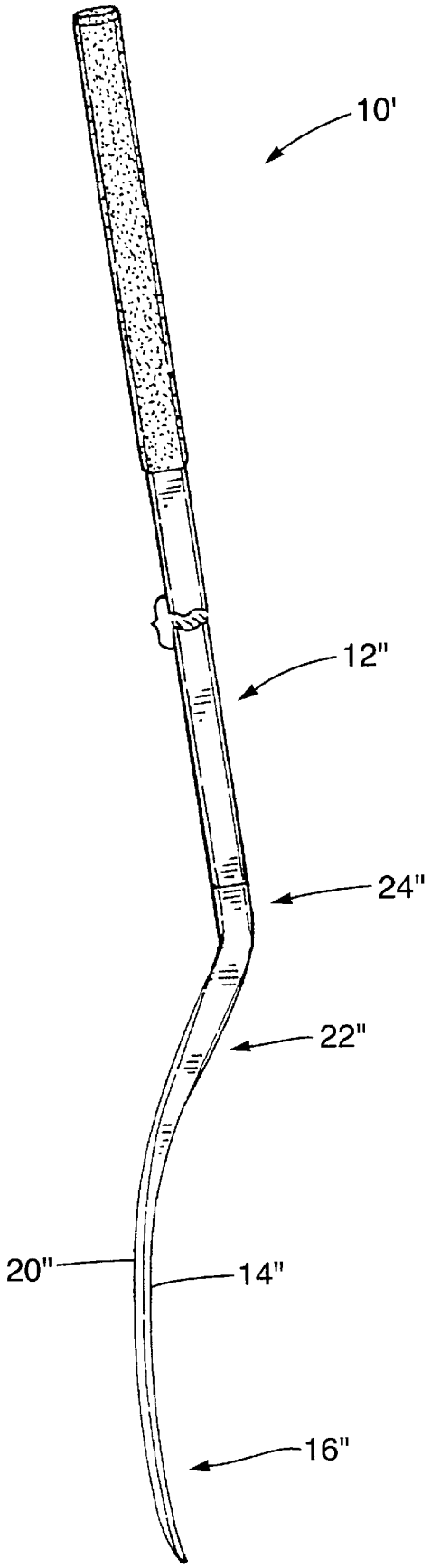
FIG. 13 is a top view of yet another alternative embodiment with a tangent negative offset in accordance with the invention.

In FIG. 13, yet another embodiment is shown with a single bend 24" in the negative angular direction with respect to the plane of the face of the blade. This form is referred to as the tangent negative (TN) offset configuration. The offset here is provided in a plurality of preselected angular increments with respect to the plane of the blade. Thus, the longitudinal axis of the handle shaft 12' will be angularly disposed, preferably within the range of 1°–12° with respect to the plane of the blade 14'. In the production of such sticks, it is proposed that angular offsets in increments of 1° would provide a wide selection of stick selection for different players.

Figure 9:
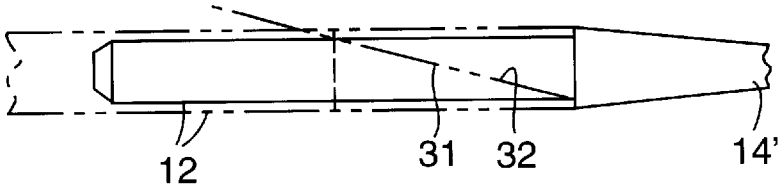
FIGS. 9, 10 and 11 are portions taken between the lines 9, 10 or 11, respectively in FIG. 3 and show assembly methods for either parallel or tangent forms of the hockey sticks.
Figure 10:
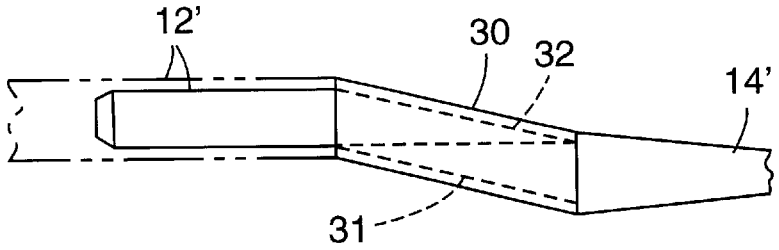
Figure 11:
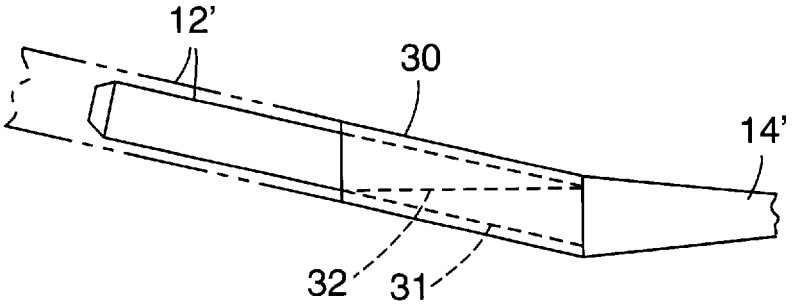

As shown in FIGS. 9, 10 and 11, the manufacture of the stick using an angular cut and assembly with a carbon composite or aluminum sleeve 30 would be the same for either the parallel or tangent offset configurations. Cuts can be made such as indicated at 31, 32 that allow for either variation to be selectively assembled.

Figure 12:
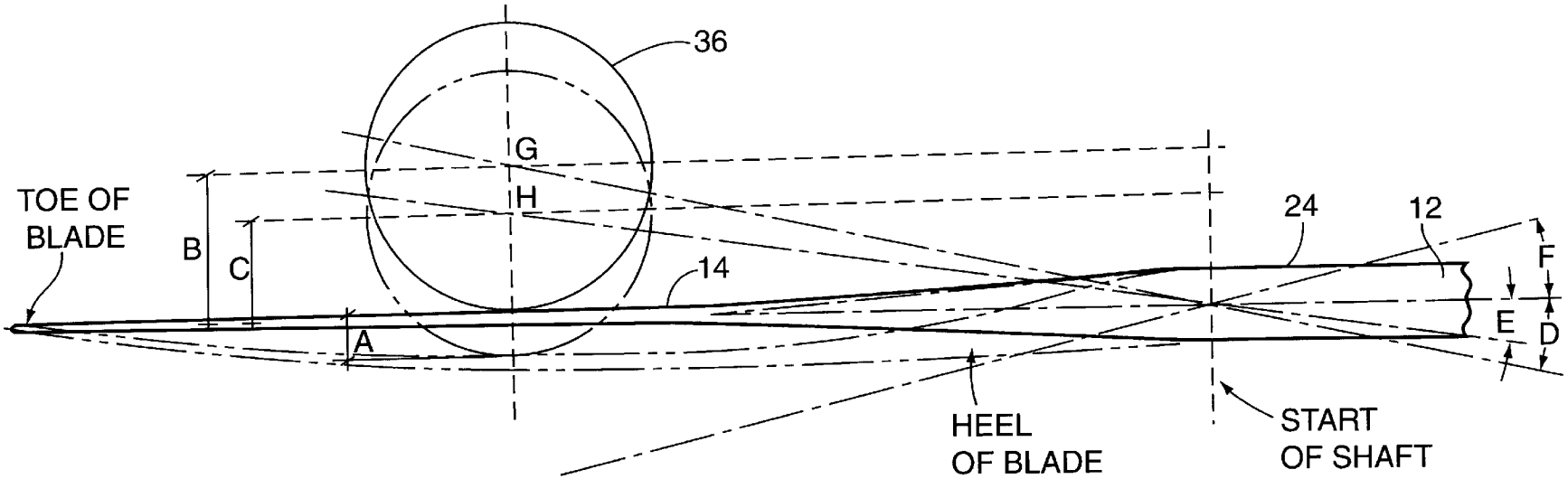
FIG. 12 is a diagrammatic top view of a stick and puck showing the manner in which angular adjustment relates to the puck.

Referring to FIG. 12, there is illustrated diagrammatically the parameters and relationships between the stick 12, blade 14 and puck 36 within which the offset forms of the present invention are preferably applied. Table I provides the referenced parameters identified in FIG. 12.

TABLE I

A=Maximum curvature of the blade (under NHL Rule 19-B=½ inch/1.27 cm).

B=Parallel positive offset for a straight blade or 1 ½ inches/3.81 cm.

C=Parallel positive offset for a maximum curved blade or 1 inch/2.54 cm.

D=Shaft angle for tangent offset negative with a straight blade.

E=Shaft angle for tangent offset negative with a maximum curved blade.

F=Shaft angle for tangent offset positive.

G=Center of puck with a straight blade.

H=Center of puck for a maximum curved blade.

In Table II there is set forth the exemplary correlation between the blade curves and offsets that provide a complement, i.e., an alignment of the lineal axis of the shaft with the center of the puck to optimize the efficient transfer of forces to the puck.

TABLE II

CURVE IN BLADE + OFFSET IN SHAFT = TOTAL COMPLEMENT (½ Diameter of 3" puck)

| Inches | Inches Parallel Positive | Degrees Tangent Negative | Inches |
|---|---|---|---|
| | | | 1.50 |
| 0 | 1.50 | 12 | 1.50 |
| .125 | 1.375 | 11 | 1.50 |
| .25 | 1.25 | 10 | 1.50 |
| .375 | 1.125 | 9 | 1.50 |
| .50 | 1 | 8 | 1.50 |
| (.625)* | .625 | 7 | 1.50 |
| (.75)* | .75 | 6 | 1.50 |
| (.875)* | .625 | 5 | 1.50 |
| (1)* | .50 | 4 | 1.50 |
| (1.125)* | .375 | 3 | 1.50 |
| (1.25)* | .25 | 2 | 1.50 |
| (1.375)* | .125 | 1 | 1.50 |
| (1.50)* | 0 | 0 | 1.50 |

*( )Not allowed by NHL RULE #19 STICKS

The Table II referenced effects of PP and TN offsets begins with any amount of offset and continues to increase as the offset increases with the maximum effect occurring when the lineal axis of the shaft is in alignment with the center of gravity of the puck. Any increase in offset past this point will cause a slinging of the puck.

The following examples apply particularly to the parallel positive (PP) and tangent negative (TN) offset configurations:

Example A: When making a forehand pass or a forehand shot, the mass of the puck is now in balance on the blade and is preloaded for forward movement. This eliminates the need for the extra motion to reset the blade on the puck before passing or shooting, resulting in a quicker release.

Example B: When making a forehand pass or a forehand shot, the mass of the puck is now in balance on the blade and will spin around its vertical axis at a greater rate of revolution as it leaves the blade. The result is a more boring shot known in hockey as a "heavy shot". This type of shot tends to bite into a goaltender's equipment and continues moving on its original trajectory at the goal instead of ricocheting away, making it more difficult for goaltenders to stop the puck. A pass results in a more boring pass and will tend to stick on the receiving player's blade instead of ricocheting away.

Example C: When making a forehand shot the mass of the puck is now in balance on the blade and will spin around its vertical axis at a greater rate of revolution as it leaves the blade, resulting in a shot that when it starts to loose its velocity the spin will take over, causing the puck to curve off its original trajectory in the direction of the attitude of the puck at the time of its loss of velocity, much like the effect the stitchings attitude has on a baseball when throwing a curve ball, resulting in making it more difficult for goaltenders to stop the puck.

Example D: When making a forehand shot the mass of the puck is now in balance on the blade, the players will be able to reduce the amount of effort exerted without effecting the speed of the shot, resulting in more control for the shooter.

Example E: When stick handling and carrying the puck on the forehand while moving forward, the mass of the puck is now balanced on the blade allowing the player to feel the mass of the puck better negating the need for the player to visually find the puck, resulting in easier and greater puck control for the stick handler.

Turning now to the comparative effects and variations in use achievable with the different offsets, the following comparisons apply:

Effects of offsets on the ability to pickup the puck and carry it with the stick and shoot the puck vertically TN—Decreases the ability to pickup the puck and carry it and shoot the puck vertically when the vertical plane of the tip of the blade is placed parallel to the ice, concave curve up, the lineal axis of the shaft as it leaves the blade is now pointed tangent down at the ice resulting in making it more difficult for the player to get the tip of the blade under the flat side of the puck that is resting on the ice.

PP—Increases the ability to pickup the puck and carry it with the stick and shoot the puck vertically when the vertical plane of the tip of the blade is placed parallel to the ice, concave curve up, the lineal axis of the shaft as it leaves the blade is now lifted parallel off the ice resulting in making it easier for the player to get the tip of the blade under the flat side of the puck that is resting on the ice.

TP—Increases the ability to pickup the puck and carry it with the stick and shoot the puck vertically when the vertical plane of the tip of the blade is placed parallel to the ice, concave curve up, the lineal axis of the shaft as it leaves the blade is now pointed tangent up from the ice resulting in making it easier for the player to get the tip of the blade under the flat side of the puck that is resting on the ice.

PN—Decreases the ability to pickup the puck and carry it with the stick and shoot the puck vertically when the vertical plane of the tip of the blade is placed parallel to the ice, concave curve up, the lineal axis of the shaft as it leaves the blade is now dropped parallel toward the ice resulting in making it more difficult for the player to get the tip of the blade under the flat side of the puck that is resting on the ice.

Effect of offsets on the ability to hide the puck and decrease the telegraphing of a shot or pass to the opposing players TN—Increases the telegraphing of a shot or pass because it moves the puck forward in the players stance when keeping the face of the blade in the same plane as a non offset shaft stick, exposing the puck to the view of the goaltender or opposing player.

PP—Decreases the telegraphing of a shot or pass because it moves the puck back in the players stance when keeping the face of the blade in the same plane as a non offset shaft stick, and hides it from the view of the goaltender or opposing player.

TP—Decreases the telegraphing of a shot or pass because it moves the puck back in the players stance when keeping the face of the blade in the same plane as a non offset shaft stick, and hides the puck from the view of the goaltender, or opposing player.

PN—Increases the telegraphing of a shot or pass because it moves the puck forward in the players stance when keeping the face of the blade in the same plane as a non offset shaft stick, exposing the puck to the view of the goaltender or opposing player.

Effect of offsets on the ability to draw the puck on the forehand laterally towards the body while moving forward TN—Decreases the ability to draw the puck on the forehand laterally towards the body while moving forward when the vertical plane of the tip of the blade is placed parallel to the ice, concave curve down, resulting in the vertical plane of the tip being less parallel to the player, making it more difficult to control the puck.

PP—Increases the ability to draw the puck on the forehand laterally towards the body while moving forward when the vertical plane of the tip of the blade is placed parallel to the ice, concave curve down, resulting in the vertical plane of the tip being more parallel to the player, making it easier to control the puck.

TP—Increases the ability to draw the puck on the forward laterally towards the body while moving forward when the vertical plane of the tip of the blade is placed parallel to the ice, concave curve down, resulting in the vertical plane of the tip being more parallel to the player, making it easier to control the puck.

PN—Decreases the ability to draw the puck on the forward laterally towards the body while moving forward when the vertical plane of the tip of the blade is placed parallel to the ice, concave curve down, resulting in the vertical plane of the tip being less parallel to the player, making it more difficult to control the puck.

In addition to the foregoing as to the referenced forms, the following apply:

TN & PP—The offset shaft reduces the need for curve in the blade allowing for the use of a straighter blade, increasing control on the backhand for passing, shooting, and stick handling because the functions performed by the curve in the blade are now transferred to the offset in the shaft.

TN & PP—The offset of the shaft is in compliment to the curve in the blade as it relates to the alignment of the lineal axis of the shaft with the center of gravity of the puck. By adjusting the offset and the curve to each other in compliment, sticks can be more customized to the individual players style resulting in maximizing a players ability.

TN & PP—The offset in the shaft creates a set of mathematical coordinates using lineal measurements and angles that will allow the governing bodies of the game of hockey to set limits and specifications on the complete stick, while maximizing the efficiencies of the stick, resulting in enhancing the skill level of the game of hockey.

TN/TP—The Tangent offset is more easily manufactured because it has a single bend vs. two bends necessary for a Parallel Positive offset.

TN—In order to intersect the center of gravity of the puck the Tangent Negative offset requires less radical bending physically and visually to the players eye than the Parallel Positive offset.

TN—As the location of the Tangent Negative offset bend moves up the shaft towards the players hands, the degree of angle necessary to accomplish the intersection of the lineal axis of the shaft with the center of gravity of the puck is reduced.

PP & TP—The user shoots off of the back foot.

TN—The user shoots off of the front foot.

In Table III, there is a comparative summary chart for the different offsets highlighting the effects and benefits available with each form.

TABLE III

| | OFFSET FORM | | | |
|---|---|---|---|---|
| | PP | PN | TP | TN |
| The closer the offset is to the blade, the better | X | | X | X |
| Gravity closing or cupping action | X | | | X |
| Degrees & angles offset numerical numbering system | X | | | X |
| No extra motion | X | | | X |
| Boring shot or pass | X | | | X |
| Spin velocity curve | X | | | X |
| Reduced effort | X | | | X |
| Carrying puck | X | | | X |
| Pickup puck | X | | X | |
| Hide puck | X | | X | |
| Draw forehand laterally | X | | X | |
| Reduced curve in blade | X | | | X |
| Complete curve & offset | X | | | X |
| Mathematical coordinates | X | | | X |
| Ease of manufacturing | | | X | X |
| Less radical bending to get center of gravity | | | | X |
| Less angle towards hands for center of gravity | | | | X |
| Location of heel & start of shaft | X | | X | X |
| Complement curve & offset | X | | | X |

What is claimed is:

1. In a hockey stick with an elongated rectangular cross-section handle shaft, the handle shaft having sides and a longitudinal center line axis parallel to planes of the sides of the handle shaft, a blade at one end of the handle shaft, the blade being at an obtuse angle with respect to the handle shaft, and the blade having a heel end, a toe end, and front and rear face planes with the handle shaft being joined to the blade by a transition section having a cross-section with top, bottom, front and rear sides, the front and rear sides in side lanes of the transition section tapering between the heel end of the blade and the handle shaft and the cross-section of the transition section blending into the joining of the heel end of the blade, the improvement comprising an offsets a first bend which begins approximately where the transition section meets the offset, wherein the offset is angular to a plane parallel to the front face plane of the blade.

2. A hockey stick as claimed in claim 1 comprising a second bend located where the off set meets the handle shaft and the longitudinal center line axis of the handle shaft beyond the second bend is parallel to the front face plane of the blade.

3. A hockey stick as claimed in claim 1 wherein the handle shaft is coupled to the blade in a three piece arrangement by means of a coupling member.

4. A hockey stick as claimed in claim 1 wherein the first bend extends in a direction toward the front face plane of the blade and a second bend extends back toward a plane parallel to the of the front face plane of the blade so that the handle shaft is offset forwardly of the blade.

5. A hockey stick as claimed in claim 1, wherein the first bend extends in a direction toward the front face plane of the blade so that the handle shaft is offset forwardly of the front face plane of the blade.

6. A hockey stick as claimed in claim 5 wherein longitudinal center line axis of the handle shaft is at an angle of between approximately 1° and 12° with respect to the front face plane of the blade.

7. A hockey stick as claimed in claim 1 wherein the first bend extends in a direction toward the rear face plane of the blade so that the handle shaft is offset rearwardly of the rear face plane of the blade.

8. A hockey stick as claimed in claim 7 wherein longitudinal center line axis of the handle shaft is at an angle of between approximately 1° and 12° with respect to rear face plane of the blade.

9. A hockey stick as claimed in claim 1 wherein the first bend begins approximately where the cross section of the transition section becomes equal in shape to the cross section of the handle shaft.

* * * * *